US010006638B2

(12) United States Patent
Kim

(10) Patent No.: US 10,006,638 B2
(45) Date of Patent: Jun. 26, 2018

(54) COOKTOP ASSEMBLIES AND METHODS FOR OPERATING SAME

(71) Applicant: General Electric Company, Schenectady, NY (US)

(72) Inventor: Seog-Tae Kim, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 240 days.

(21) Appl. No.: 14/986,758

(22) Filed: Jan. 4, 2016

(65) Prior Publication Data

US 2017/0191672 A1 Jul. 6, 2017

(51) Int. Cl.

| | |
|---|---|
| ***H05B 3/68*** | (2006.01) |
| ***F24C 3/12*** | (2006.01) |
| ***F24C 7/08*** | (2006.01) |
| ***H05B 1/02*** | (2006.01) |
| ***H05B 3/74*** | (2006.01) |
| ***H05B 6/64*** | (2006.01) |

(52) U.S. Cl.

CPC ..... *F24C 3/126* (2013.01); *F24C 7/083* (2013.01); *H05B 1/0266* (2013.01); *H05B 3/748* (2013.01); *H05B 6/647* (2013.01); *H05B 2213/07* (2013.01)

(58) Field of Classification Search

CPC .... F24C 7/04–7/046; F24C 7/06–7/067; F24C 7/08–7/088; H05B 3/68; H05B 3/74–3/746; H05B 6/00; H05B 6/06–6/062

USPC ..... 219/443.1–468.2

See application file for complete search history.

(56) References Cited

U.S. PATENT DOCUMENTS

| | | | | |
|---|---|---|---|---|
| 4,810,857 A * | 3/1989 | Goessler | ..... | H05B 3/746 219/448.19 |
| 6,150,641 A * | 11/2000 | Wilkins | ..... | H05B 1/0213 219/494 |
| 7,102,109 B2 | 9/2006 | Niiyama et al. | | |
| 7,105,781 B2 * | 9/2006 | Wilkins | ..... | H05B 3/746 219/481 |

FOREIGN PATENT DOCUMENTS

| | | |
|---|---|---|
| EP | 0021107 B1 | 3/1983 |
| JP | 2002075610 A | 3/2002 |

* cited by examiner

*Primary Examiner* — Sang Y Paik

(74) *Attorney, Agent, or Firm* — Dority & Manning, P.A.

(57) ABSTRACT

Cooktop assemblies and methods for operating cooktop assemblies are provided. A cooktop assembly includes a top panel for supporting a cooking vessel, the top panel comprising an upper surface and a lower surface, and a heating assembly disposed adjacent the lower surface, the heating assembly comprising a heating element. The cooktop assembly further includes a first temperature sensor configured to measure a first temperature between the heating assembly and the top panel, and a second temperature sensor configured to measure a second temperature of the top panel.

14 Claims, 5 Drawing Sheets

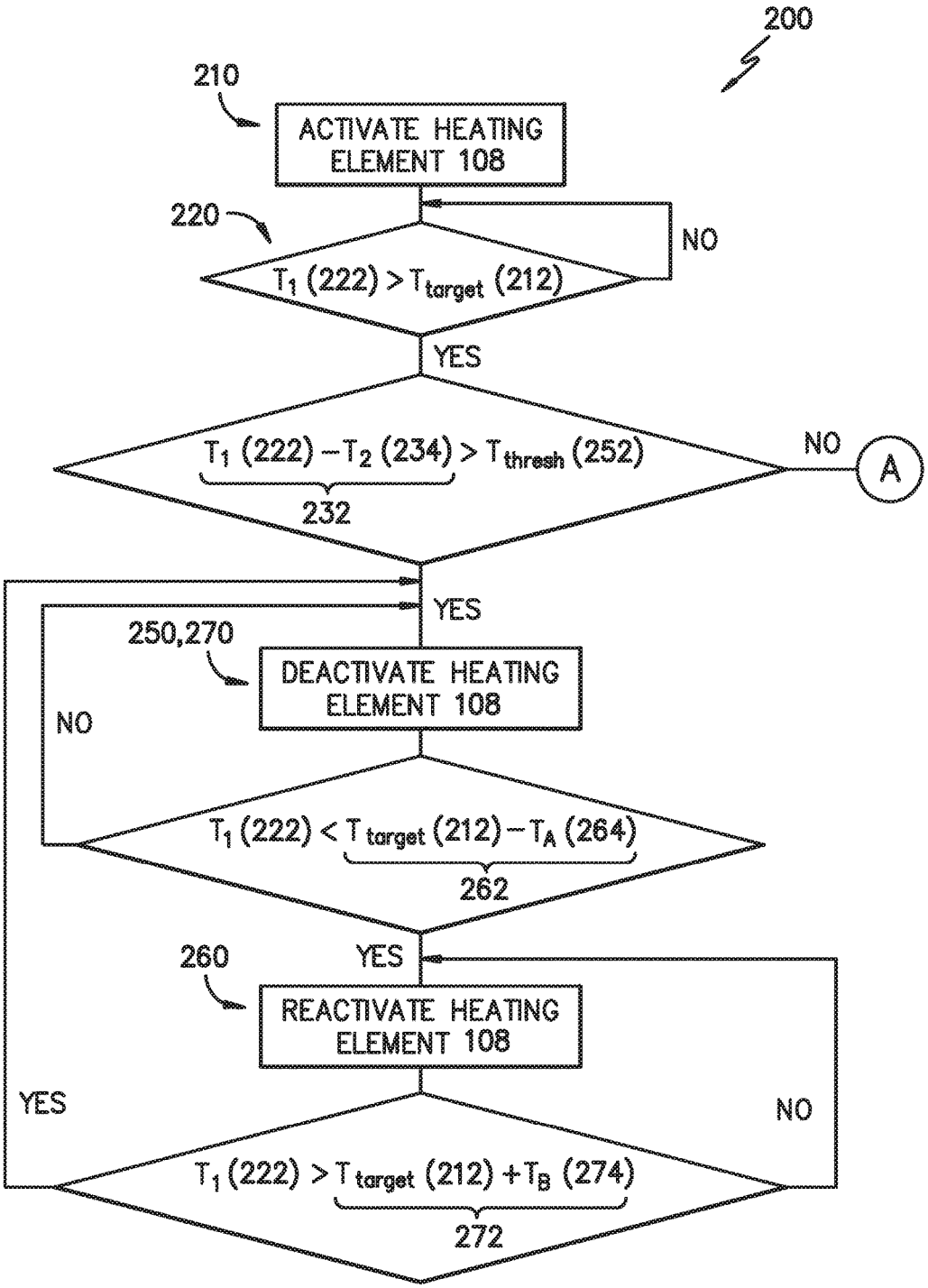
FIG. −6A−

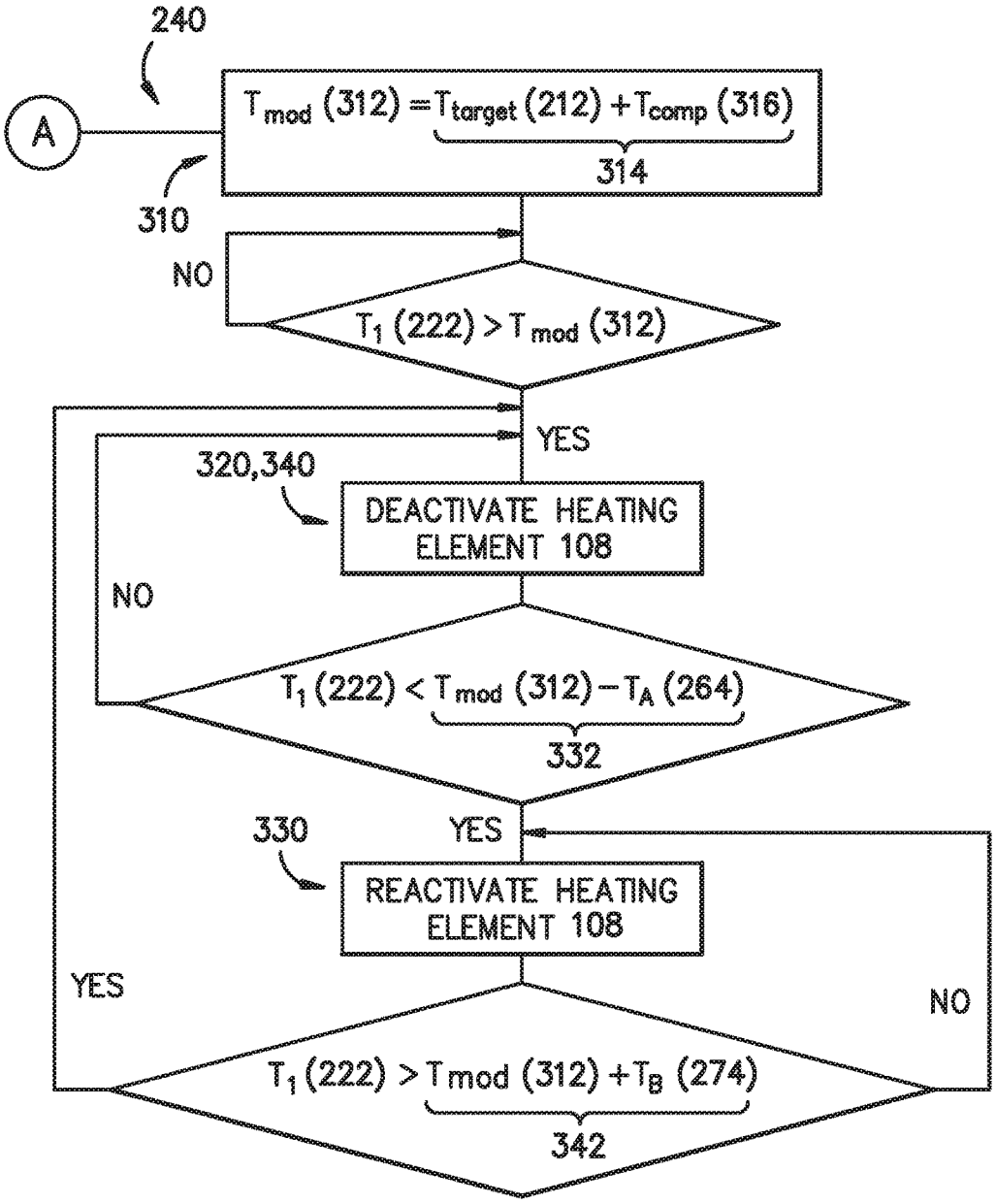
*FIG. –6B–*

COOKTOP ASSEMBLIES AND METHODS FOR OPERATING SAME

FIELD OF THE INVENTION

The present disclosure relates generally to cooktop assemblies, such as stand-alone heat plates and burners or assemblies for cooktops or oven appliances, and methods for operating such cooktop assemblies.

BACKGROUND OF THE INVENTION

Cooktop assemblies are frequently utilized in a variety of settings to cook food items. In particular, cooktop assemblies are utilized to heat liquids, food items, etc. held in vessels, such as pots or pans, which are positioned on the cooktop assemblies. Cooktops, which may be utilized alone or built in to oven appliances, frequently include a plurality of cooktop assemblies on which such containers can be positioned. A heating element of the cooktop assembly is then turned on to heat the liquid within the container.

One concern during such operation of cooktop assemblies is the number of variables that can affect the desired cooking temperature. For example, the size of the vessel, the amount of liquids, food items, etc. held in the vessel, and other variables may affect the desired cooking temperature. Presently known cooktop assemblies do not include suitable feedback apparatus for monitoring any of these variables and adjusting the heating operations of the heating element in response to such monitoring.

Accordingly, improved cooktop assemblies and methods for operating heating assemblies are desired. In particular, cooktop assemblies and methods which provide suitable feedback apparatus for monitoring heating operations of the heating element(s) and adjusting such operations as required would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a cooktop assembly is provided. The cooktop assembly includes a top panel for supporting a cooking vessel, the top panel comprising an upper surface and a lower surface, and a heating assembly disposed adjacent the lower surface, the heating assembly comprising a heating element. The cooktop assembly further includes a first temperature sensor configured to measure a first temperature between the heating assembly and the top panel, and a second temperature sensor configured to measure a second temperature of the top panel.

In accordance with another embodiment, a method for operating a cooktop assembly is provided. The method includes activating a heating element of a heating assembly, and determining if a first temperature between the heating assembly and a top panel is greater than a predetermined target temperature. The method further includes calculating a first difference between the first temperature and a second temperature of the top panel when the first temperature is greater than the predetermined target temperature. The method further includes selectively maintaining activation of the heating element based on the first difference.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 6, including FIGS. 6A and 6B, provides a flow chart illustrating a method for operating a cooktop assembly according to embodiments of the present disclosure.

DETAILED DESCRIPTION OF THE INVENTION

Figure 1:
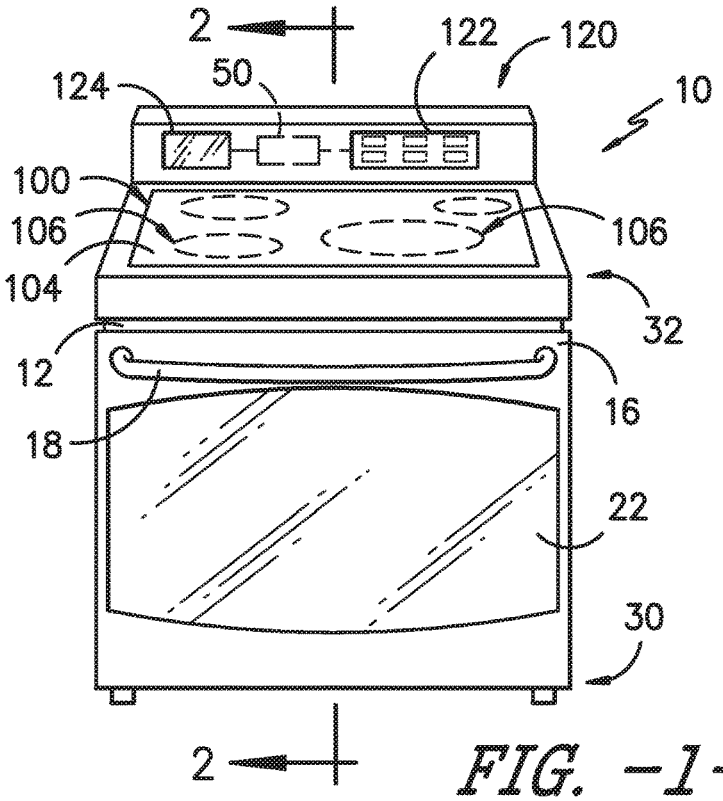
FIG. 1 provides a perspective view of an oven appliance according to embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
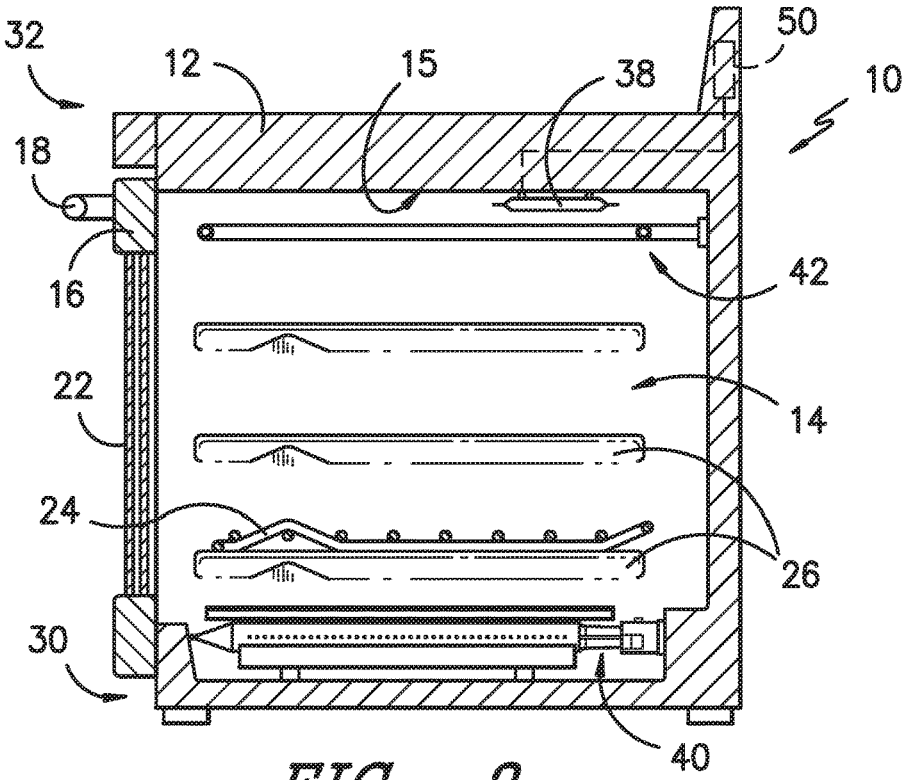
FIG. 2 provides a section view of the oven appliance of FIG. 1 taken along the 2-2 line of FIG. 1.

FIG. 1 provides a perspective view of an oven appliance 10 according to an exemplary embodiment of the present subject matter. FIG. 2 provides a section view of oven appliance 10 taken along the 2-2 line of FIG. 1. Oven appliance 10 is provided by way of example only and is not intended to limit the present subject matter in any aspect. Thus, the present subject matter may be used with other oven appliance configurations, e.g., that define one or more interior cavities for the receipt of food and/or having different pan or rack arrangements than what is shown in FIG. 2. Further, the present subject matter may be used in any other suitable appliance.

Oven appliance 10 generally includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14.

Oven appliance 10 can include a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open.

A gas fueled or electric bottom heating element 40 (e.g., a gas burner or a bake gas burner) is positioned in cabinet 12, e.g., at a bottom portion 30 of cabinet 12. Bottom heating element 40 is used to heat cooking chamber 14 for both cooking and cleaning of oven appliance 10. The size and heat output of bottom heating element 40 can be selected based on the e.g., the size of oven appliance 10.

A top heating element 42 is also positioned in cooking chamber 14 of cabinet 12, e.g., at a top portion 32 of cabinet 12. Top heating element 42 is used to heat cooking chamber 14 for both cooking/broiling and cleaning of oven appliance 10. Like bottom heating element 40, the size and heat output of top heating element 42 can be selected based on the e.g., the size of oven appliance 10. In the exemplary embodiment shown in FIG. 2, top heating element 42 is shown as an electric resistance heating element. However, in alternative embodiments, a gas, microwave, halogen, or any other suitable heating element may be used instead of electric resistance heating element 42.

The operation of oven appliance 10 including heating elements 40 and 42 is controlled by a processing device such as a controller 50, which may include a microprocessor or other device that is in communication with such components. Such controller 50 may also be communication with a temperature sensor 38 that is used to measure temperatures inside cooking chamber 14 and provide such measurements to the controller 50. Temperature sensor 38 is shown (in FIG. 2) in the top and rear of cooking chamber 14. However, other locations may be used and, if desired, multiple temperature sensors may be applied as well.

Figure 3:
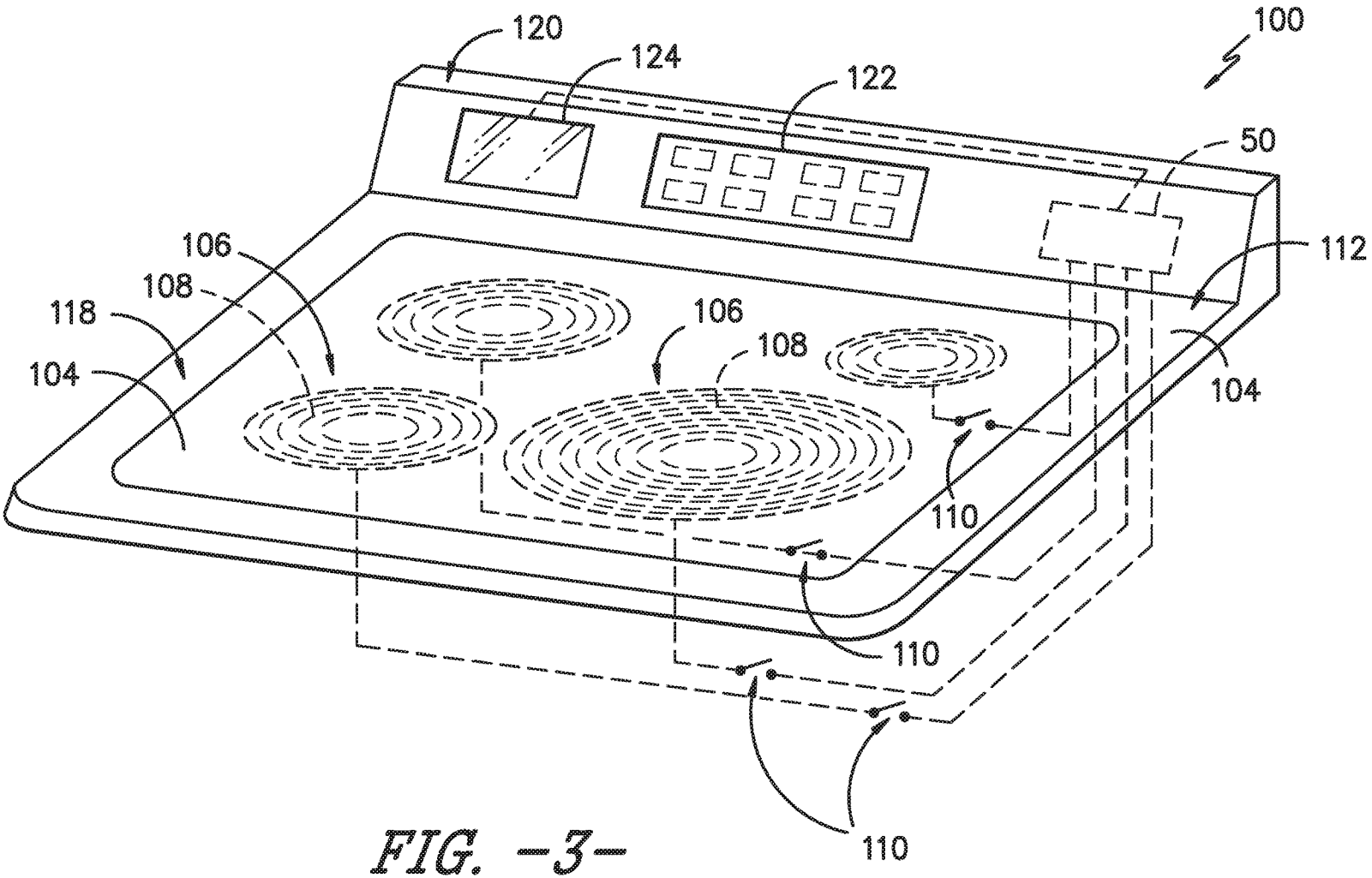
FIG. 3 provides a perspective view of a cooktop according to embodiments of the present disclosure.

Referring now to FIGS. 1 and 3, a cooktop 100 is illustrated. Cooktop 100 may be included in oven appliance 10, as illustrated in FIG. 1, or may be a separate appliance from oven appliance 10. For example, in the embodiment of FIG. 1, cooktop 100 may be disposed on the cabinet 12. As show, cooktop 100 may include a top panel 104. By way of example, top panel 104 may be constructed of glass, ceramics, enameled steel, and combinations thereof. Heating assemblies 106, which in this embodiment are electric heating assemblies but in alternative embodiments may be gas burners or induction assemblies, may be mounted, for example, below the top panel 104. While shown with four heating assemblies 106 in the exemplary embodiment of FIG. 3 (as well as FIG. 1), cooktop appliance 100 may include any number of heating assemblies 106 in alternative exemplary embodiments. Heating assemblies 106 can also have various diameters. For example, each heating assembly of heating assemblies 106 can have a different diameter, the same diameter, or any suitable combination thereof. Each heating assembly may include one or more heating elements 108. Further, a relay 110 may be coupled to each heating element 108. Relays 110 can selectively activate the associated heating elements 108 as desired. Activation of a heating element 108 can cause electricity to be flowed to that heating element 108, which in turn can cause the heating element 108 to generate heat. This heat may be transferred through the top panel 104 to utensils positioned on the top panel 104. The operation of heating elements 108, such as through operation of relays 110, may be controlled by a processing device such as controller 50.

Referring to FIGS. 1 through 3, oven appliance 10 and/or cooktop 100 may further include a user interface panel 120. User interface panel 120 is generally a component that allows a user to interact with the oven appliance 10 to, for example, turn various heating elements (such as heating elements 40, 42, 108) on and off, adjust the temperature of the heating elements, set built-in timers, etc. A user interface panel 120 may include a touchscreen 122 and a graphical display 124, which may be separate from or a part of the touchscreen 122. The touchscreen 122, as discussed herein, may be utilized by a user to interact with the oven appliance 10 by touching the touchscreen 122 directly with, for example, a finger. Various commands for a user to select through such touching may be displayed by touchscreen 122, and detection of the user selecting a specific command by touching a distinct location on the touchscreen 122 may be detected by the controller 50, which is in communication with the touchscreen 122, based on electrical signals from the touchscreen 122. Graphical display 124 may generally deliver certain information to the user, which may be based on user selections and interaction with the touchscreen 122, such as whether a particular heating element is activated and/or the level at which the heating element is set.

In alternative embodiments, user interface panel 120 may include, for example, one or more knobs, buttons, or other suitable input apparatus.

Notably, controller 50 may be in communication with the touchscreen 122 and graphical display 124 or other suitable input apparatus of the user interface panel 120, and may further be in communication with the one or more heating elements, as well as temperature sensors as discussed herein. Accordingly, input signals received from the touchscreen 122 and the temperature sensors may be provided to and interpreted by the controller 50, and the controller 50 may output corresponding control signals to the heating elements to operate the heating elements as desired.

Controller 50 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 50 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. User interface panel 120 and other components of oven appliance 10 may be in communication with controller 50 via one or more signal lines or shared communication busses.

Figure 4:
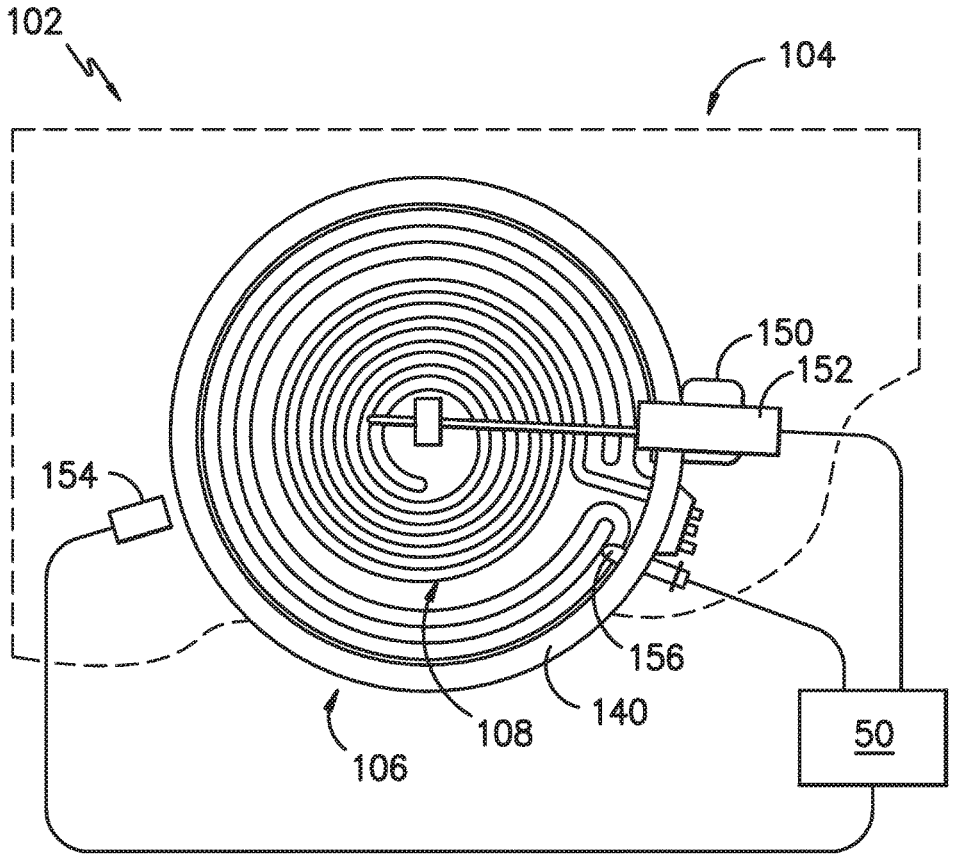
FIG. 4 provides a top view of a cooktop assembly according to embodiments of the present disclosure.
Figure 5:
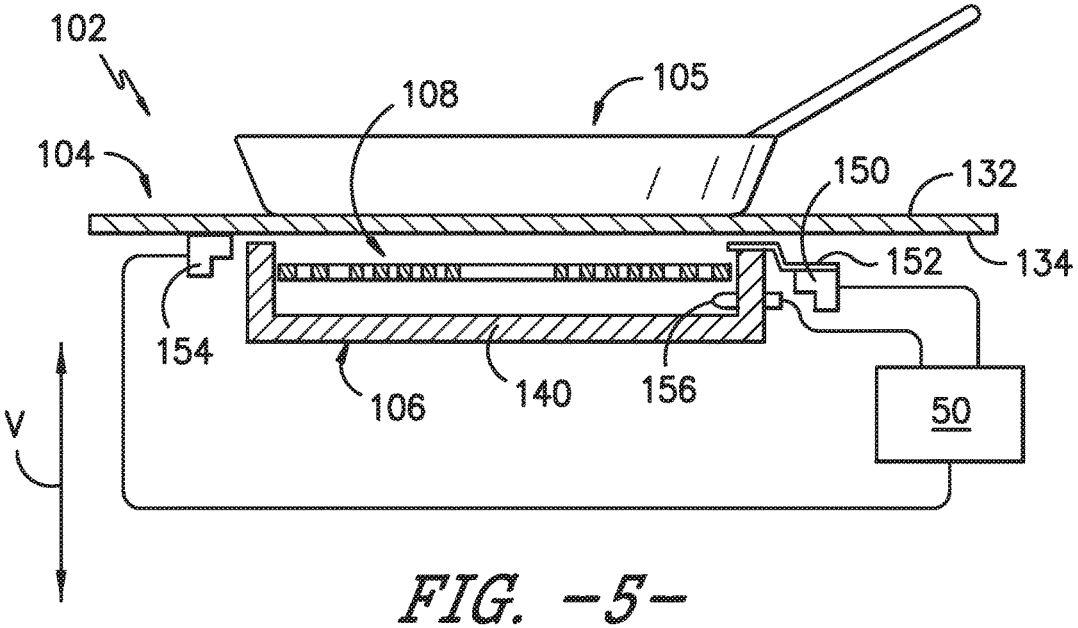
FIG. 5 provides a side sectional view of a cooktop assembly according to embodiments of the present disclosure.

Referring now to FIGS. 4 and 5, embodiments of cooktop assemblies 102 in accordance with the present disclosure are provided. A cooktop assembly 102 in accordance with the present disclosure may include a top panel 104 and a heating assembly 106, as illustrated. Top panel 104 may support a cooking vessel 105, as illustrated. Cooking vessel 105 may be any suitable vessel capable of withstanding heat and being utilized in cooking operations, such as a pot or pan. As illustrated, top panel 104 may include an upper surface 132 and an opposing lower surface 134. The surfaces 132, 134 may be spaced apart along a vertical direction V, with the upper surface 132 above the lower surface 134.

In exemplary embodiments, top panel 104 may be formed from a ceramic. Alternatively, however, other suitable materials may be utilized to form top panel 104.

Heating assembly 106 may be disposed adjacent the top panel 104, such as adjacent the lower surface 134. Accordingly, heating assembly 106 may be below the top panel 134 along the vertical direction V. Heating assembly 106 may include the heating element 108, and may further include a frame 140 that at least partially surrounds the heating element 108. Heating element 108 may, for example, be a resistive heating element, such as a resistive coil as illustrated. Accordingly, when activated, electricity may pass through the heating element and encounter resistance in the element, generating heat as a result. When deactivated, no electricity may be passed through the heating element.

Frame 140 may, for example, be formed from a suitable metal or another suitable material. As shown, frame 140 may at least partially surround the heating element 108, such as the coiled portion in resistive coil embodiments.

Cooktop assembly 102 may further include multiple temperature sensors for measuring temperatures at various positions in cooktop assembly 102. In exemplary embodiments, the temperature sensors are thermistors. A first temperature sensor 150, for example, may be provided for measuring a first temperature between the heating assembly 106 and the top panel 104, such as between the heating assembly 106 and the top panel 104 along the vertical direction V. In exemplary embodiments, first temperature sensor 150 may measure the first temperature between the frame 140 and the top panel 104, such as between the frame 140 and the top panel 104 along the vertical direction V.

In some embodiments, first temperature sensor 150 may itself be disposed between the heating assembly 106 and the top panel 104, such as between the frame 140 and the top panel 104. Alternatively, first temperature sensor 150 may be in contact with a heat transfer plate 152. The heat transfer plate 152 may be at least partially disposed between the heating assembly 106 and the top panel 104, such as between the frame 140 and the top panel 104, as illustrated. For example, a portion of the heat transfer plate 152 may be disposed between the heating assembly 106 and top panel 104, and another portion may extend therefrom away from the heating element 108. First temperature sensor 150 may be in contact with the portion of the heat transfer plate 152 that extends away from the heating element 108 (and is thus outside of the heating assembly 106 along a direction transverse to the vertical direction V. Heat transfer plate 152 in exemplary embodiments may be formed from a metal or other suitable conductive material. Accordingly, first temperature sensor 150 may measure the temperature of heat transfer plate 152 which may correspond to the temperature between the heating assembly 106 and the top panel 104.

A second temperature sensor 154 may additionally be provided. The second temperature sensor 154 may measure a second temperature of the top panel 104. For example, in exemplary embodiments as illustrated, the second temperature sensor 154 may be in contact with the top panel 104, such as with the lower surface 134 thereof. Alternatively, a heat transfer plate may, for example, be disposed between and in contact with the top panel 104 and the second temperature sensor 154. Second temperature sensor 154 may, due to such contact, measure a second temperature of the top panel 104. Notably, the second temperature sensor 154 may be positioned outside of the heating assembly 106 along a direction transverse to the vertical direction V.

In some embodiments, a third temperature sensor 156 may additionally be provided. The third temperature sensor 156 may measure a third temperature within the heating assembly 106, such as within the frame 140 and proximate the heating element 108. According, third temperature sensor 156 may be disposed at least partially within the heating assembly 106 as illustrated. For example, a portion of the third temperature sensor 156 may be disposed within the heating assembly 106, such as within the frame 140, and a portion may extend therefrom through the frame 140 and outside of the frame 140 (such as along a direction transverse to the vertical direction V).

As discussed, a controller, such as controller 50, may be in communication with the first temperature sensor 150, second temperature sensor 154 and/or third temperature sensor 156. Controller 50 may thus advantageously operate the heating element 108 based at least in part on inputs temperatures (i.e. first temperature, second temperature and/or third temperature) from the sensors 150, 154, 156.

Referring now to FIG. 6, methods 200 for operating cooktop assemblies 102 are provided. Methods 200 in accordance with the present disclosure advantageous utilize various sensed temperature, such as sensed first and second temperatures as discussed herein, to regulate activation of the heating element 108. The multiple sensed temperatures may advantageously provide improved feedback to the controller 50, resulting in improved heating element 108 regulation.

In exemplary embodiments, controller 50 may be configured to perform various steps of method 200 as discussed herein.

Method 200 may, for example, include the step 210 of activating the heating element 108. For example, in exemplary embodiments, controller 50 may activate the heating element 108, as discussed herein. Such activation may be a result of a user input to, for example, a user input apparatus of a user interface panel such as user interface panel 120. For example, a user may indicate that use of the cooktop assembly 102 is desired, and may set a desired temperature for such use. The desired temperature may be provided to and received by the controller 50, and may be considered a predetermined target temperature 212.

Method 200 may further include, for example, the step 220 of determining if a first temperature 222, such as the first temperature measured by first temperature sensor 150, is greater than the predetermined target temperature 212. When the first temperature 222 is less than (and thus not greater than) the predetermined target temperature 212, the heating element 108 may remain activated. When the first temperature 222 is greater than the predetermined target temperature 212, method step 230 may occur.

Method 200 may further include, for example, the step 230 of calculating a first difference 232 between the first temperature 222 and a second temperature 234, such as the second temperature measured by second temperature sensor 154. Such step 230 may occur, for example, when the first temperature 222 is greater than the predetermined target temperature 212. Measurement of the first difference 232 may advantageously facilitate improved regulation of the heating element 108. For example, different algorithms for further deactivation and reactivation of the heating element 108 may be utilized based on the level of the first difference 232. The level of the first difference 232 may, for example, correspond to different sizes of vessels 105 that are being utilized in conjunction with heating assembly 102 and/or different levels of liquids, food items, etc. contained within the vessels 105.

Accordingly, method 200 may further include the step 240 of selectively maintaining activation of the heating element 108 based on the first difference 232. In accordance with step 240, heating element 108 may be selectively deactivated and reactivated in various manners based on the first difference 232. Notably, such selective activation maintenance may facilitate improved heating by the heating element 108 based on the predetermined target temperature 212 and the vessel 105, etc. being utilized.

For example, step 240 may include the step 250 of deactivating the heating element 108. Such deactivation may occur when the first difference 232 is greater than a predetermined first difference threshold 252. The predetermined first difference threshold 252 may be predetermined value that is, for example, stored in controller 50. In some embodiments, for example, the threshold 252 may be between −2 and 2 degrees Fahrenheit, such as between 0 and 2 degree Fahrenheit.

In these embodiments, step 240 may further include the step 260 of re-activating the heating element 108 after deactivation in accordance with step 250. Such re-activation may occur when the first temperature 222 is less than a second difference 262. The second difference 262 may be a difference between the predetermined target temperature 212 and a predetermined first constant 264. The predetermined first constant 264 may be predetermined value that is, for example, stored in controller 50. In some embodiments, for example, the predetermined first constant 264 may be between −2 and 2 degrees Fahrenheit, such as between 0 and 2 degree Fahrenheit.

In these embodiments, step 240 may further include the step 270 of deactivating the heating element 108 after re-activation in accordance with step 260. Such deactivation may occur when the first temperature 222 is greater than a sum 272 of the predetermined target temperature 212 and a predetermined second constant 274. The predetermined second constant 274 may be predetermined value that is, for example, stored in controller 50. In some embodiments, for example, the predetermined first constant 264 may be between −2 and 2 degrees Fahrenheit, such as between 0 and 2 degree Fahrenheit.

Notably, steps 250, 260 and/or 270 may, in some embodiments, be repeated as required during operation of the cooktop assembly 102 to facilitate improved cooktop assembly 102 operation.

Additionally or alternatively, step 240 may include the step 310 of calculating a modified target temperature 312. The modified target temperature 312 may be a sum 314 of the predetermined target temperature 212 and a predetermined compensation value 316. The predetermined compensation value 316 may be predetermined value that is, for example, stored in controller 50. In some embodiments, for example, the predetermined compensation value 316 may be between −2 and 2 degrees Fahrenheit, such as between 0 and 2 degree Fahrenheit. Such step 310 may, for example, occur when the first difference 232 is less than the predetermined first difference threshold 252.

In these embodiments, step 240 may further include the step 320 of deactivating the heating element 108. Such deactivation may occur when the first difference 232 is greater than the modified target temperature 312.

In these embodiments, step 240 may further include the step 330 of re-activating the heating element 108 after deactivation in accordance with step 320. Such re-activation may occur when the first temperature 222 is less than a third difference 332. The third difference 332 may be a difference between the modified target temperature 312 and a predetermined constant, such as the predetermined first constant 264.

In these embodiments, step 240 may further include the step 340 of deactivating the heating element 108 after re-activation in accordance with step 330. Such deactivation may occur when the first temperature 222 is greater than a sum 342 of the modified target temperature 312 and a predetermined constant, such as the predetermined second constant 274.

Notably, steps 310, 320, 330 and/or 340 may, in some embodiments, be repeated as required during operation of the cooktop assembly 102 to facilitate improved cooktop assembly 102 operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cook op assembly, comprising:

a top panel for supporting a cooking vessel, the top panel comprising an upper surface and a lower surface;

a heating assembly disposed adjacent the lower surface, the heating assembly comprising a heating element;

a first temperature sensor configured to measure a first temperature between the heating assembly and the top panel;

a second temperature sensor configured to measure a second temperature of the top panel; and a controller in communication with the first temperature sensor and the second temperature sensor, the controller configured to:

activate the heating element;

determine if the first temperature is greater than a predetermined target temperature;

calculate a first difference between the first temperature and the second temperature when the first temperature is greater than the predetermined target temperature; and selectively maintain activation of the heating element based on the first difference, wherein selectively maintaining activation comprises:

deactivating the heating element when the first difference is greater than a predetermined first difference threshold;

re-activating the heating element after deactivation when the first temperature is less than a second difference between the predetermined target temperature and a predetermined first constant; and deactivating the heating element after re-activation when the first temperature is greater than a sum of the predetermined target temperature and a predetermined second constant.

2. The cooktop assembly of claim 1, wherein the second temperature sensor is in contact with the lower surface.

3. The cooktop assembly of claim 1, further comprising a heat transfer plate at least partially disposed between the top panel and the heating assembly, the first temperature sensor in contact with the heat transfer plate.

4. The cooktop assembly of claim 3, wherein the heat transfer plate is formed from a metal.

5. The cooktop assembly of claim 1, wherein the top panel is formed from a ceramic.

6. The cooktop assembly of claim 1, wherein the heating assembly further comprises a frame, the frame at least partially surrounding the heating element.

7. The cooktop assembly of claim 1, wherein the heating element is a resistive heating element.

8. The cooktop assembly of claim 1, wherein the heating element is a resistive coil.

9. The cooktop assembly of claim 1, further comprising a third temperature sensor disposed at least partially within the heating assembly and configured to measure a third temperature within the heating assembly.

10. A method for operating a cooktop assembly, the method comprising:

activating a heating element of a heating assembly;

determining if a first temperature between the heating assembly and a top panel is greater than a predetermined target temperature;

calculating a first difference between the first temperature and a second temperature of the top panel when the first temperature is greater than the predetermined target temperature; and selectively maintaining activation of the heating element based on the first difference:

wherein the selectively maintaining activation step comprises:

calculating a modified target temperature when the first difference is less than the predetermined first difference threshold, wherein the modified target temperature is a sum of the predetermined target temperature and a predetermined compensation value;

deactivating the heating element when the first temperature is greater than the modified target temperature;

re-activating, the heating element after deactivation when the first temperature is less than a third difference between the modified target temperature and a predetermined first constant; and deactivating the heating element after re-activation when the first temperature is greater than a sum of the modified target temperature and a predetermined second constant.

11. The method of claim 10, wherein the top panel is formed from a ceramic.

12. The method of claim 10, wherein the heating element is a resistive heating element.

13. The method of claim 10, wherein the first temperature is measured by a first temperature sensor in contact with a heat transfer plate, the heat transfer plate at least partially disposed between the top panel and the heating element.

14. The method of claim 10, wherein the second temperature is measured by a temperature sensor in contact with a lower surface of the top panel.

* * * * *